US005497794A

United States Patent [19]

Okumoto

[11] Patent Number: 5,497,794

[45] **Date of Patent: * Mar. 12, 1996**

[54] CIGARETTE

[75] Inventor: Yutaka Okumoto, Tokyo, Japan

[73] Assignee: Japan Tobacco Inc., Tokyo, Japan

[ * ] Notice: The portion of the term of this patent subsequent to Aug. 16, 2011, has been disclaimed.

[21] Appl. No.: 246,712

[22] Filed: May 20, 1994

Related U.S. Application Data

[63] Continuation-in-part of Ser. No. 175,575, Dec. 30, 1993, Pat. No. 5,337,761.

[30] Foreign Application Priority Data

Mar. 29, 1993 [JP] Japan ..... 5-070280
Mar. 28, 1994 [JP] Japan ..... 6-057710

[51] Int. Cl.[6] ..... A24D 1/00

[52] U.S. Cl. ..... 131/364; 131/84.1; 131/360

[58] Field of Search ..... 131/360, 364, 131/84.1, 84.2

[56] References Cited

U.S. PATENT DOCUMENTS

| | | | |
|---|---|---|---|
| 2,163,414 | 6/1939 | Stephano . | |
| 3,524,452 | 8/1970 | Moser et al. . | |
| 3,587,593 | 6/1971 | Wilde et al. . | |
| 4,092,987 | 6/1978 | Imbert . | |
| 4,390,031 | 6/1983 | Berger . | |
| 4,716,913 | 1/1988 | Brackmann | 131/364 |
| 4,924,888 | 5/1990 | Perfetti | 131/364 X |
| 5,072,742 | 12/1991 | Heitmann . | |
| 5,261,425 | 11/1993 | Raker et al. | 131/364 X |
| 5,337,761 | 8/1994 | Okumoto et al. | 131/84.1 |

FOREIGN PATENT DOCUMENTS

| | | |
|---|---|---|
| 617900 | 10/1994 | European Pat. Off. . |
| 2214229 | 9/1974 | France . |
| 624846 | 9/1961 | Italy . |
| 3928539 | 12/1939 | Japan . |
| 4014560 | 3/1959 | Japan . |
| 46-8440 | 6/1967 | Japan . |
| 440484 | 1/1936 | United Kingdom . |

*Primary Examiner*—Jennifer Bahr
*Attorney, Agent, or Firm*—Birch, Stewart, Kolasch & Birch

[57] ABSTRACT

A cigarette is manufactured by executing a cigarette manufacturing process. In a cut tobacco supply process of the manufacturing process, tobacco shreds are attracted by suction onto a first tobacco band to form a cut tobacco layer. The cut tobacco layer delivered from the first tobacco band is folded into layer portions within a limited space, thereby forming a cut tobacco train. During formation of the cut tobacco train, the tobacco shreds are arranged so that their leaf surfaces cross at right angles to the direction of delivery of the cut tobacco layer. Then, the cut tobacco train is attracted by suction onto a second tobacco band, and is delivered at a speed later than a speed of delivery of the cut tobacco layer. The cut tobacco layer is permitted to be folded in the cut tobacco train because there is a difference in a delivery speed between the cut tobacco layer and the cut tobacco train. Further, the cut tobacco train is wrapped in a paper web to form a cigarette rod, and the formed cigarette rod is cut into individual cigarettes with a predetermined length. In the cigarette, the tobacco shreds are arranged so that their leaf surfaces cross at right angles to the axis of the cigarette. Therefore, the cigarette becomes harder, so that ability to maintain the appearance of the cigarette can be improved.

7 Claims, 10 Drawing Sheets

CIGARETTE

This application is a continuation-in-part of application Ser. No. 08/175,575 filed on Dec. 30, 1993, now U.S. Pat. No. 5,337,761, the entire contents of which are hereby incorporated by reference.

BACKGROUND OF THE INVENTION

1. Field of the Invention

The present invention relates to a cigarette, and more particularly, to a cigarette which is excellent in an appearance-sustaining ability.

2. Description of the Related Art

It is most important that a cigarette is excellent in flavor of smoking in the quality thereof; however, other matters on the quality are also important. For instance, it is desirable that a cigarette is beautiful in its appearance and is manufactured at low costs. In order to satisfy the conflicting requirement for manufacturing cigarettes having a high quality at low costs, various cigarette manufacturing techniques have conventionally been invented for practical applications.

To give an example relating to manufacture of cut tobacco, U.S. Pat. No. 3,524,452 discloses "process for increasing the filling capacity of tobacco" in which the moisture content of tobacco is adjusted, and the tobacco is wetted with inert organic liquid. Further, the liquid is quickly vaporized by passing the stream of tobacco in contact with a stream of heated gas, thereby expanding the tobacco. This process makes it possible to provide cigarettes including tension in its paper web even if a filling amount of tobacco is reduced.

It is also known to use a mixture of midrib shreds and leaf-meat shreds as tobacco shreds so as to effectively utilize tobacco leaves, the midrib shreds being obtained by rolling and shredding midrib portions (veins, secondary veins, etc.) of the tobacco leaves, which are separated from leaf-meat portions of the tobacco leaves and to which water is added (see Japanese Patent Publication No. 46-8440, etc.).

Moreover, various improvements have been made in cigarette manufacturing machines. In general, an improved cigarette manufacturing machine comprises a cut tobacco supply section, a wrapping section, and a cutting section. The wrapping section is supplied with a paper web, which travels in one direction in the wrapping section. The supply section feeds cut tobacco onto the paper web at the starting end of the wrapping section. As the cut tobacco, along with the paper web, passes through the wrapping section, it is wrapped in the web to form a continuous cigarette rod. Thereafter, the formed cigarette rod is delivered from the wrapping section to the cutting section. As it passes through the cutting section, the cigarette rod is cut into individual cigarettes with a predetermined length.

An example of the supply section of a cigarette manufacturing machine is disclosed in Japanese Patent Publication No. 40-14560. This conventional supply section is provided with an endless suction band, that is, a tobacco band as it is called. The tobacco band extends toward the wrapping section, and has one surface formed as a suction surface. Cut tobacco is attracted in a layer to the suction surface of the tobacco band. As the tobacco band travels, the cut tobacco layer is transported toward the wrapping section. The tobacco layer is released from the attraction at the starting end of the wrapping section, whereupon the cut tobacco is continuously fed from the tobacco band onto the paper web at the wrapping section.

Specifically, as shown in FIG. 1, tobacco shreds $K_T$ are moved toward a tobacco band 1 together with the air flow in the direction shown by an arrow C while being directed to various orientations in the air flow. Then, the tobacco shred $K_T$, which is sent by air with such an orientation that the axis of the tobacco shred crosses at right angles to the tobacco band 1 traveling in the direction shown by an arrow D, is attracted onto the tobacco band 1 at its one end by suction, as shown in FIG. 2. Thereafter, the entirety of this tobacco shred is attracted onto the tobacco band by suction, as shown in FIG. 3. On the other hand, in the case of another tobacco shred $K_T$, which is sent by air with such an orientation that the axis of the tobacco shred extends in parallel with the tobacco band 1, the whole of the tobacco shred is almost simultaneously attracted onto the tobacco band by suction (FIG. 2).

As a result, as shown in FIG. 4, a cut tobacco layer $T_L$ is formed of individual tobacco shreds $K_T$ which are stacked on a suction surface of a tobacco band 1. Thereafter, the tobacco shred $K_T$ of the layer is fed onto a paper web at the wrapping section.

As the paper web 2, along with the tobacco shreds $K_T$, passes through the wrapping section, it is first bent in the shape of a U, as shown in FIG. 5. Thereafter, both sides of the U-shaped web 2 are successively bent in a circular arc, whereupon a continuous cigarette rod is formed.

FIG. 6 shows a filter cigarette which is formed of a cigarette obtained by cutting the cigarette rod and a filter connected to the cigarette. FIG. 7 shows an end face of the filter cigarette. In FIGS. 6 and 7, reference numeral 3 denotes a lap portion which combines both side edges of the paper web 2.

As is evident from the foregoing description of the process for forming the cigarette rod, the tobacco shreds $K_T$ on the paper web 2 are kept substantially in layers even though they are wrapped in the web 2. Also, most of the tobacco shreds $K_T$ in the cigarette are oriented in one direction.

More specifically, most of the tobacco shreds $K_T$ are obtained by cutting tobacco leaves. As shown in the exaggerated view of FIG. 8, these tobacco shreds $K_T$ are rectangular fragments each having a pair of long sides $K_{le}$ with a length L and a pair of short sides $K_{se}$ with a length S.

Most of these fragments $K_T$ tend to be attracted to the tobacco band 1 with an orientation such that their respective long sides $K_{le}$ extend along the traveling direction of the tobacco band 1. As shown in FIGS. 4 through 7, therefore, most of the stacked fragments $K_T$ are oriented so that their short sides $K_{se}$ extend parallel to the cross section of the tobacco band 1 or the paper web 2, and their long sides $K_{le}$ at right angles to the cross section.

As viewed from the end face of the cigarette shown in FIG. 7, most of the individual tobacco shreds $K_T$ are wrapped in the paper web 2 in a manner such that their short sides $K_{se}$ extend parallel to the lap portion 3 of the cigarette.

As described above, most of tobacco shreds $K_T$ are attracted onto the tobacco band 1 by suction so that their long sides $K_{le}$ are positioned along the traveling direction of the tobacco band 1. During the movement of the tobacco shreds $K_T$ toward the tobacco band 1 with the air flow, however, the tobacco shreds $K_T$ can be directed to various orientations; for this reason, all of long sides $K_{le}$ of the tobacco shreds $K_T$ are not always positioned parallel to the traveling direction of the tobacco band 1. Nevertheless, in the case where the supply of tobacco shreds and the formation of cigarette rods are performed in the aforementioned manner, the tobacco shreds $K_T$ are arranged at least so that their leaf surfaces $K_F$ extend along the axis of cigarette (see FIG. 9).

The tobacco shreds $K_T$ more easily undergo elastic deformation when their opposite leaf surfaces $K_F$ (see FIG. 8) are subjected to external forces than when their long and short sides $K_{le}$ and $K_{se}$ receive external forces.

Thus, in the case where the tobacco shreds $K_T$ in the cigarette take the form of a layer as described above, in other words, in the case where the tobacco shreds $K_T$ are arranged so that their leaf surfaces $K_F$ extend along the axis of cigarette, if the cigarette is subjected to external forces in the direction A—A, as shown in FIG. 7, these forces act on the opposite leaf surfaces of most of the tobacco shreds $K_T$ in the cigarette, so that the outer peripheral surface of the cigarette is easily deformed.

If the cigarette is subjected to external forces in the direction B—B. On the other hand, these forces act on the long sides $K_{le}$ of most of the tobacco shreds $K_T$ in the cigarette, so that the outer peripheral surface of the cigarette cannot be easily deformed.

As described above, in the cigarette whose hardness is higher in the direction B—B than in the direction A—A, there is irregularity of hardness in the circumferential direction of the cigarette. In this case, the cigarette is easily deformed. More specifically, when a smoker nips the cigarette between his or her fingers, as shown in FIG. 10, if a nipping force acts on the leaf surfaces of the tobacco shreds $K_T$, cockles appear in the paper web 2, so that the cigarette is injured in its appearance. Further, if impact exerting in the axial direction of the cigarette acts on the cigarette, the tobacco shreds at the tip of cigarette retract inwardly to form a depression. This also injures the appearance of the cigarette.

In order to maintain a preferable appearance of cigarette, the cigarette may be formed to have a suitable hardness so that the cigarette has an ability of self-sustaining its appearance. Generally, the higher the filling density of tobacco shreds is made, the harder the cigarette becomes. Thus, it is possible to manufacture a cigarette which has a suitable hardness and an excellent ability to maintain its appearance by adjusting the filling density of cut tobacco. However, since cigarettes must be provided at low costs even if the cigarettes have whatever high quality, an increase of the filling density of cut tobacco to a considerable extent causes costs to rise because cut tobacco is high-priced, and is hence impractical.

SUMMARY OF THE INVENTION

The object of the present invention is to provide a cigarette which has increased hardness and an improved appearance-self-sustaining ability while permitting a filling amount of cut tobacco or tobacco shreds per cigarette to be reduced.

According to the present invention, there is provided a cigarette in which a filler including tobacco shreds obtained by cutting tobacco leaves is wrapped in a packing member made of paper. The cigarette is characterized in that the tobacco shreds are arranged so that most of the tobacco shreds have their leave surfaces extending substantially perpendicularly to the axis of the cigarette.

Preferably, most of the tobacco shreds are radially arranged around the axis of the cigarette in a cross section intersecting perpendicularly to the axis of the cigarette.

Preferably, the cigarette includes a cut tobacco train as the filler. The cut tobacco train is comprised of cut tobacco layer portions which individually extend substantially perpendicularly to the axis of the cigarette and which overlap with one another. Preferably, the cut tobacco train is formed by effecting a folding process for delivering a cut tobacco layer, obtained by arranging the tobacco shreds, in one direction, and for folding the delivered cut tobacco layer into the cut tobacco layer portions. More preferably, the cut tobacco train is formed by executing the folding process within a limited space, while delivering the cut tobacco train in the same direction as the direction of delivery of the cut tobacco layer at a speed smaller than the delivering speed of the cut tobacco layer.

Preferably, the cigarette is manufactured by a cigarette manufacturing process including a cut tobacco supply step. This supply step includes a first supply process for forming the cut tobacco layer by suction and continuously delivering the formed cut tobacco layer, a folding and forming process for folding the delivered cut tobacco layer into the tobacco layer portions and piling these tobacco layer portions on one another in the direction of delivering the cut tobacco layer to form the cut tobacco train, and a second supply process for receiving the formed cut tobacco train by suction and continuously delivering the received cut tobacco train.

More preferably, the cigarette is manufactured by executing a wrapping step of wrapping the cut tobacco train in the packing member to form a continuous cigarette rod and a cutting step of cutting the formed cigarette rod into a predetermined length, after the cut tobacco supply step is performed.

The present invention is advantageous in that tobacco shreds are arranged so that most of tobacco shreds have their surfaces positioned perpendicularly to the axis of the cigarette. As a result, it is possible to increase the hardness of the resultant cigarette without increasing a filling amount of cut tobacco, and to improve the ability to maintain the appearance of the cigarette. Thus, even if an external force is applied to the cigarette, it is not easily deformed. Also, the packing member, i.e., a paper web of the cigarette is strongly tensed, so that cockles are hard to occur in the cigarette. Further, a depression is hard to occur in the cut tobacco situated at the tip of the cigarette even if impact is applied to the cigarette. Therefore, the appearance of the cigarette of the present invention is maintained appropriately, so as to satisfy needs of customers sufficiently. In addition, if the hardness of the cigarette is permitted to be kept at the same level as that in the conventional cigarette, the manufacturing cost can be lowered by reducing a filling amount of the cut tobacco in the cigarette.

According to a preferred embodiment of the present invention in which most of the tobacco shreds are radially arranged in a cross section intersecting perpendicularly to the axis of the cigarette, the hardness of the resultant cigarette is uniform in the circumferential direction thereof, and is increased in magnitude, so that the cigarette is not easily deformed. Therefore, this feature is highly effective to maintain a preferable appearance of the cigarette.

Further, according to the preferred embodiment of the present invention including a cut tobacco train serving as a filler and comprised of cut tobacco layer portions which individually extend perpendicularly to the axis of the cigarette and which overlap with one another, the cut tobacco train is formed by effecting a folding process for delivering the cut tobacco layer, obtained by arranging tobacco shreds, in one direction, and for folding the formed cut tobacco layer into the tobacco layer portions. In this case, most of the tobacco shreds are arranged so that their leaf surfaces are oriented perpendicularly to the axis of the cigarette. Therefore, the cigarette which is excellent in ability to maintain the appearance thereof can be provided at low costs.

These and other objects and advantages will become more readily apparent from an understanding of the preferred embodiments described below with reference to the following drawing figures.

BRIEF DESCRIPTION OF THE DRAWINGS

The present invention will become more fully understood from the detailed description herein below with reference to the accompanying figures, given by way of illustration only and not intended to limit the present invention, wherein.

DETAILED DESCRIPTION OF THE PREFERRED EMBODIMENT

Figure 11:
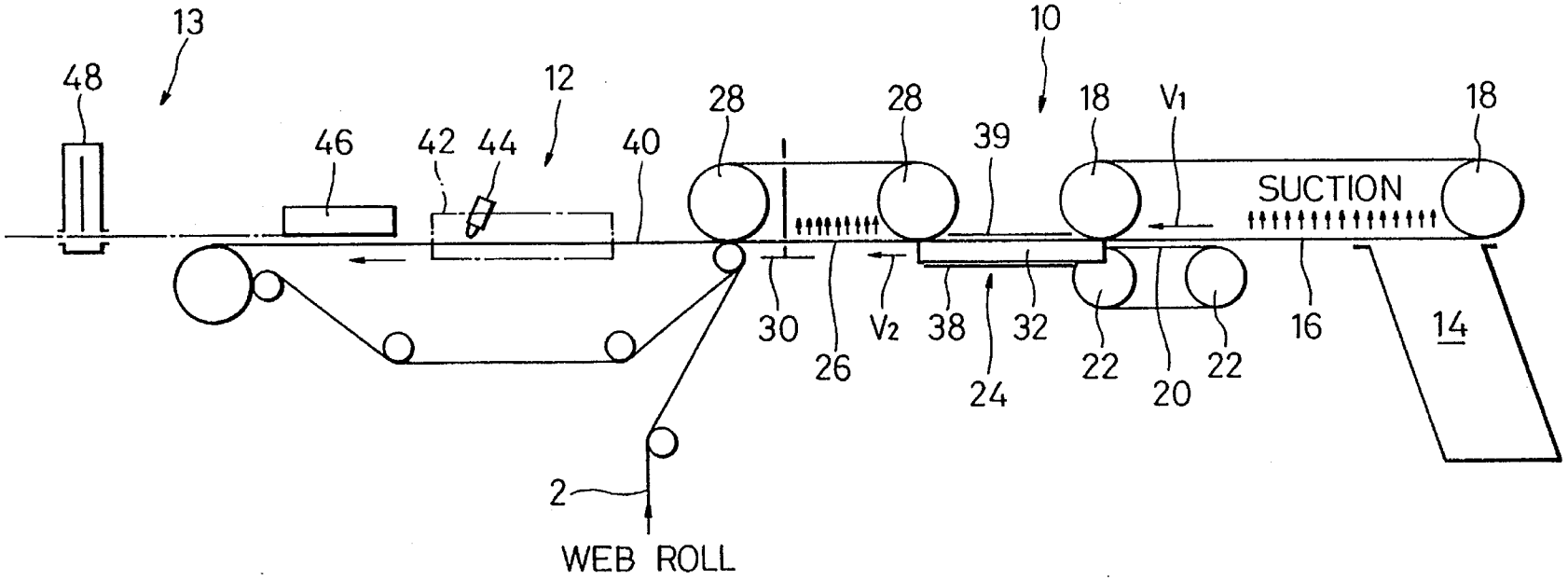
FIG. 11 is a schematic view showing a cigarette manufacturing machine for manufacturing cigarettes according to one embodiment of the present invention.

A cigarette manufacturing machine shown in FIG. 11 comprises a cut tobacco supply section 10, wrapping section 12, and a cutting section 13. These sections 10, 12 and 13 are arranged successively from right to left of FIG. 11.

The supply section 10 includes a chimney 14, and cut tobacco or tobacco shreds are introduced into the chimney 14 through a supply drum (not shown). The introduced tobacco shreds are sucked in together with air, and ascend in the chimney 14.

A top opening of the chimney 14 is closed by a first tobacco band 16, which extends toward the wrapping section 12. The band 16 is formed of an endless suction belt, which is formed having a number of suction holes (not shown). The first tobacco band 16 is passed around and between a pair of drums 18, and is run in the direction of the arrow of FIG. 11 at a predetermined traveling speed $V_1$.

The tobacco shreds, ascending together with air in the chimney 14, are attracted in a layer to the underside of the first tobacco band 16, whereby a cut tobacco layer with a predetermined thickness is formed on the band 16. As the first tobacco band 16 travels, the tobacco layer is transported from the chimney 14 to the wrapping section 12.

Figure 1:
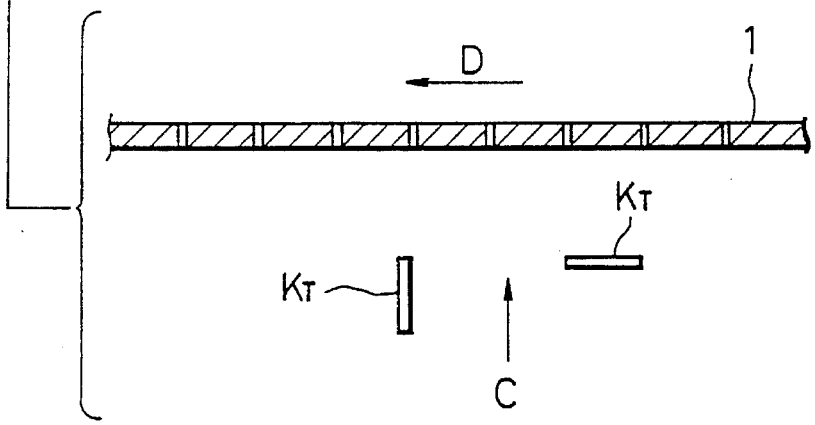
FIG. 1 is a schematic view showing a state in which tobacco shreds are sent by air toward a traveling tobacco band.
Figure 2:
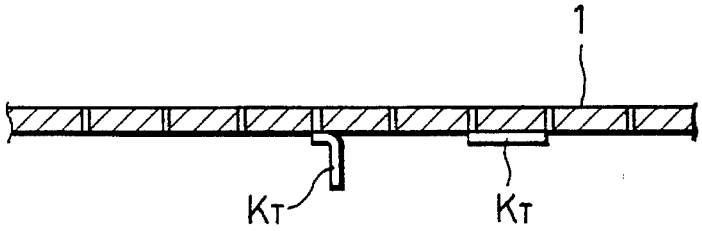
FIG. 2 is a schematic view showing a state in which a tobacco shred, sent by air with such an orientation that the axis of the tobacco shred crosses at right angles to the tobacco band, is attracted by suction onto the tobacco band at its one end, and the whole of another tobacco shred is attracted onto the tobacco band.
Figure 3:
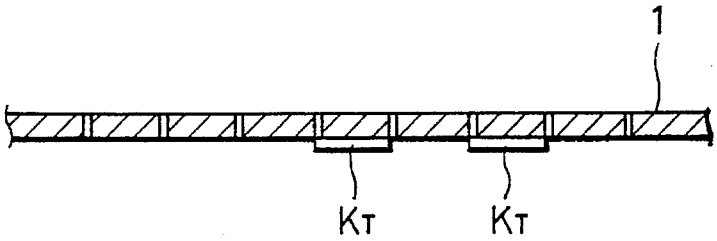
FIG. 3 is a schematic view showing a state in which the whole of the tobacco shred, sent by air with such an orientation that the axis of the tobacco shreds crosses at right angles to the tobacco band, is attracted onto the tobacco band.
Figure 4:
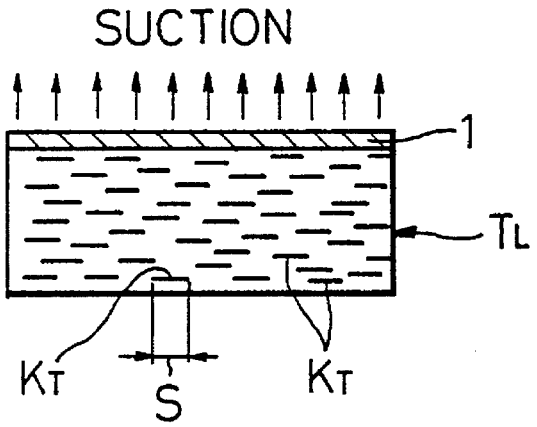
FIG. 4 is a view showing tobacco shreds attracted in a layer to the tobacco band.
Figure 5:
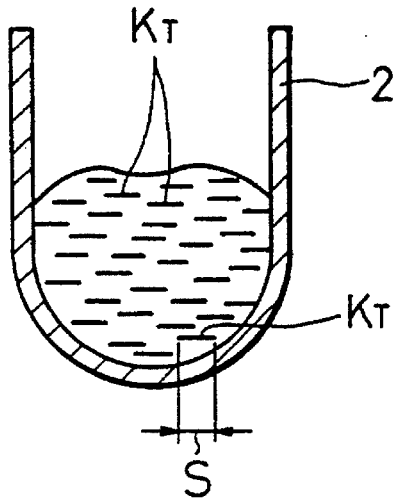
FIG. 5 (PRIOR ART)
FIG. 5 is a view showing a paper web bent in the shape of a U.
Figure 6:
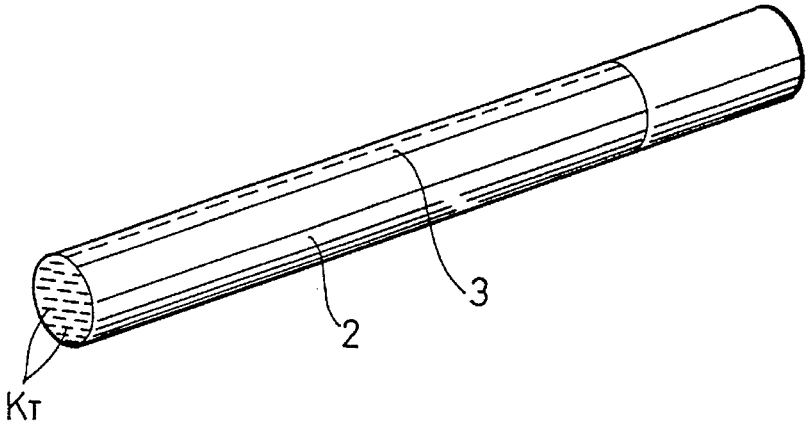
FIG. 6 is a perspective view of a filter cigarette manufactured by the conventional method.
Figure 7:
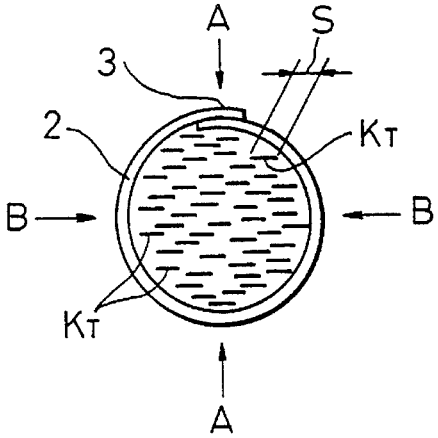
FIG. 7 is an end view of the filter cigarette shown in FIG. 6.
Figure 8:
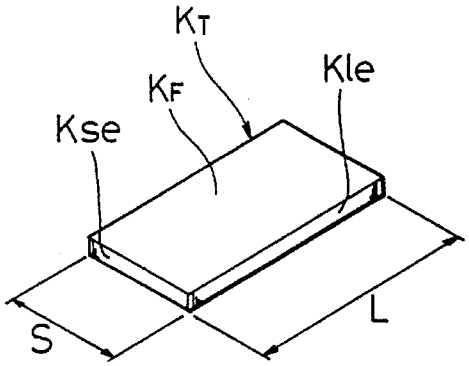
FIG. 8 is an enlarged perspective view of a tobacco shred.
Figure 9:
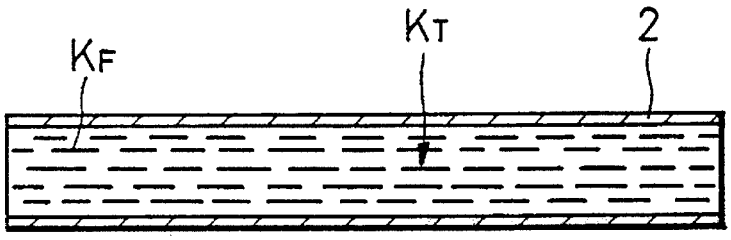
FIG. 9 is a schematic longitudinal section view showing an arrangement of tobacco shreds in a conventional cigarette.
Figure 10:
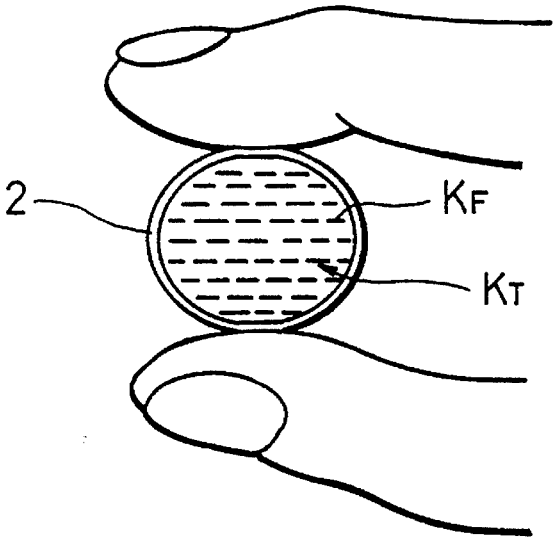
FIG. 10 is a schematic view showing a state in which a smoker nips a conventional cigarette between fingers.

The cut tobacco layer on the first tobacco band 16 is formed in the same manner as the cut tobacco layer $T_L$ on the tobacco band 1 shown in FIG. 4. However, the traveling speed $V_1$ of the first tobacco band 16 is N times (e.g., five times) as high as that of the tobacco band 1 of FIG. 4. Therefore, the tobacco band 16 moves on the chimney 14 in a shorter period of time than the tobacco band 1, so that the tobacco layer on the band 16 is about one-N'th as thick as the tobacco layer $T_L$ on the band 1.

The traveling speed of the tobacco band 1 is set on the basis of the quantity of cut tobacco to be supplied to a paper web 2.

A tobacco drum may be used in place of the first tobacco band 16. In this case, the outer peripheral surface of the tobacco drum is formed as a suction surface.

An endless press belt 20 underlies the terminal end portion of the first tobacco band 16. The belt 20, which is situated right under the band 16, is passed around and between a pair of rollers 22. The roller 22 on the left of the press belt 20, as shown in FIG. 11, is situated right under the drum 18 of the first tobacco band 16.

The press belt 20 is run at a speed equal to the traveling speed $V_1$ of the first tobacco band 16. The traveling direction of the belt 20 is opposite to that of the band 16. Thus, those portions of the band 16 and the belt 20 which face each other travel in the same direction and at the same speed.

The press belt 20 has a width equal to that of the first tobacco band 16. The distance between the belt 20 and the band 16 is a little shorter than the thickness of the cut tobacco layer formed on the belt 16.

The press belt 20 is vertically movable with respect to the first tobacco band 16, so that the distance between the belt 20 and the band 16 is adjustable, and a jam, if any, of the tobacco layer between the belt 20 and the band 16 can be removed.

Located on the left of the combination of the first tobacco band 16 and the press belt 20, as seen in FIG. 11, is an endless second tobacco band 26 which is connected to the wrapping section 12. The first and second tobacco bands 16 and 26 are connected to each other by means of a folding stack 24 for the cut tobacco layer.

The second tobacco band 26, like the first tobacco band 16, is formed of a suction belt, and is passed around and between a pair of drums 28. The traveling speed $V_2$ of the second tobacco band 26 is adjusted to one-N'th of the traveling speed $V_1$ of the first tobacco band 16. As mentioned latter, the second tobacco band 26 continuously receives a cut tobacco train from the folding stack 24 and attracts the cut tobacco train on the underside thereof.

The second tobacco band 26 is provided with a trimming disk 30, which regulates the thickness of the cut tobacco train attracted to the band 26 as it rotates. Thus, trimmed cut tobacco train is fed from the second tobacco band 26 to the wrapping section 12.

Figure 12:
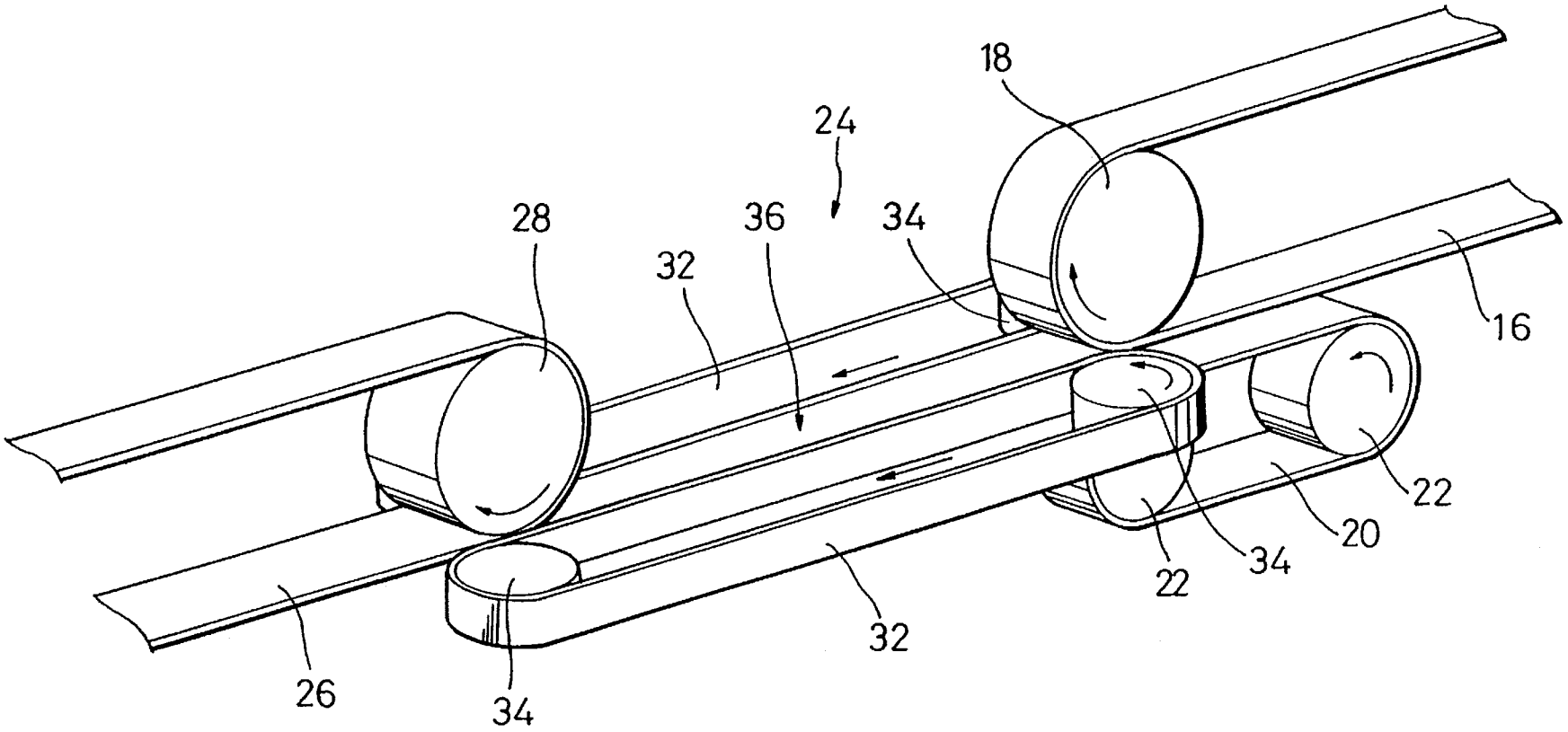
FIG. 12 is an enlarged perspective view showing a terminal end portion of a first tobacco band in a supply section of FIG. 11.

As seen from FIG. 12, the folding stack 24 includes a pair of side belts 32. Each side belt 32 is an endless suction belt which is passed around and between a pair of rollers 34. The respective axes of the rollers 34, unlike those of the drums 18 and 28 and the rollers 22, extend vertically. Thus, the paired side belts 32 extend parallel to each other between the first and second tobacco bands 16 and 26 so as to have their respective vertical belt surfaces facing each other.

The paired side belts 32 travel at a speed equal to the traveling speed $V_2$ of the second tobacco band 26 in a manner such that the aforesaid belt surfaces move from the first tobacco band 16 toward the second band 26, as indicated by the arrows in FIG. 12.

A distance equal to the width of each of the first and second tobacco bands 26 and 26 is secured between the paired side belts 32, and the width of each side belt 32 is set to be about N times the thickness of the cut tobacco layer formed on the first tobacco band 16.

Figure 15:
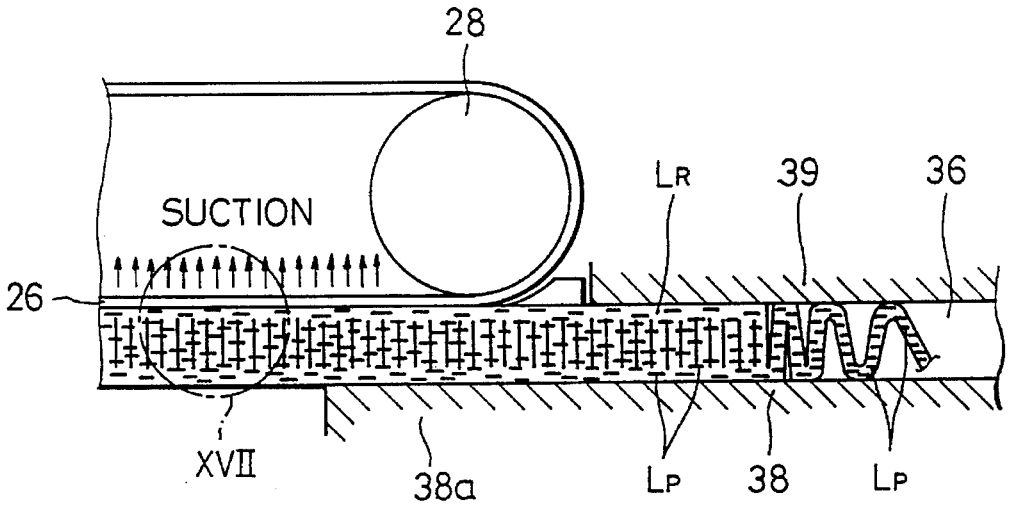
FIG. 15 is an enlarged sectional view showing a starting end portion of a second tobacco band in the supply section.

As shown in FIG. 11, a lower plate 38 and an upper plate 39 are arranged right over and under the side belts 32, respectively. These plates 38 and 39 extend from the first tobacco band 16 toward the second tobacco band 26. More specifically, as shown in FIG. 15, the upper plate 39 extends to the point Just short of the starting end portion of the second tobacco band 26, while the lower plate 38 has an extension portion 38*a* which underlies the starting end portion of the band 26 with an overlap of a predetermined length.

The aforesaid belt surfaces of the paired side belts 32 and the lower and upper plates 38 and 39 define a folding passage 36 which extends between the first and second tobacco bands 16 and 26. The passage 36 has a rectangular cross section.

The height of the folding passage 36, which depends on the width of each side belt 32, is about N times the thickness of the cut tobacco layer formed on the first tobacco band 16.

A passage between the first tobacco band 16 and the press belt 20 is situated on the level of the upper portion of the folding passage 36.

That one of the side belts 32 which is situated to the front side of the cigarette manufacturing machine is movable toward and away from the other side belt. Thus, the width of the folding passage 36 can be adjusted, and the Jammed cut tobacco in the passage 36 can be removed.

The first tobacco band 16, press belt 20, second tobacco band 26, and side belts 32 are driven by a drive system of the cigarette manufacturing machine with the aid of a power transmission system including gear belts and the like, or are driven individually by electric motors.

The second tobacco band 26 and the folding stack 24 may be replaced individually with perforated suction drums. In this case, the suction drum for the folding stack 24 is formed having an arcuate folding passage on part of its outer peripheral surface.

The following is a description of a cut tobacco supply method carried out by means of the aforementioned supply section 10.

Figure 13:
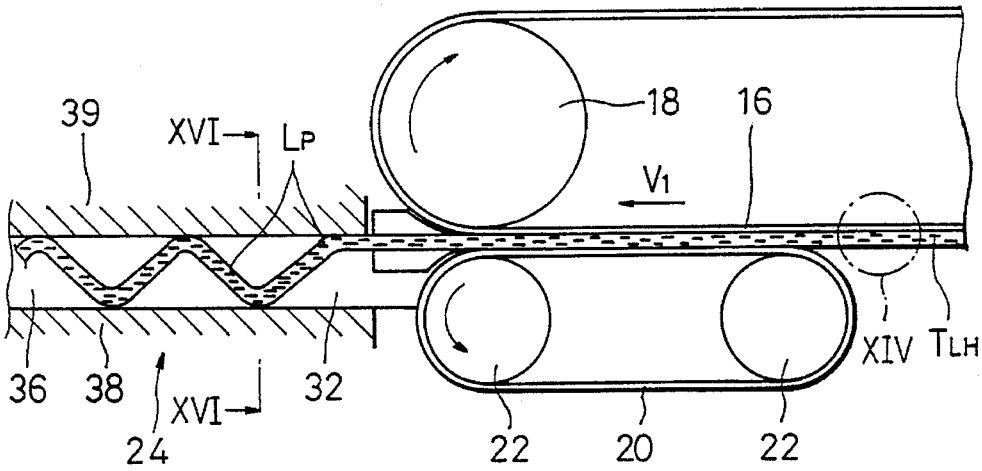
FIG. 13 is a vertical sectional view of the part shown in FIG. 12.
Figure 14:
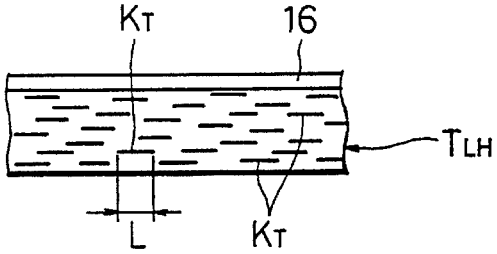
FIG. 14 is an enlarged view of a region XIV shown in FIG. 13.

As the first tobacco band 16 travels, a cut tobacco layer $T_{LH}$ thereon is first transported to the folding stack 24, as shown in FIG. 13. At this time, most of tobacco shreds $K_T$ which form the tobacco layer $T_{LH}$ tend to be attracted in the aforesaid manner so that their respective long sides $K_{le}$ extend along the traveling direction of the first tobacco band 16, as shown in FIG. 14 which is an enlarged view of the region XIV of FIG. 18.

After the cut tobacco layer $T_{LH}$ on the first tobacco band 16 is compressed between the band 16 and the press belt 20, it is released from the attraction by the band 16. Thus, the cut tobacco layer $T_{LH}$, which is transported as the tobacco band 16 travels, is delivered from between the band 16 and the belt 20 into the folding stack 24 or the folding passage 36.

Since the cut tobacco layer $T_{LH}$ is compressed, its individual tobacco shreds $K_T$ are intertwined with one another. Thus, the tobacco layer $T_{LH}$ are delivered into the folding passage 36 while maintaining its shape.

As mentioned before, the height of the folding passage 36 is about N times the thickness of the cut tobacco layer $T_{LH}$, the passage between the first tobacco band 16 and the press belt 20 is situated on the level of the upper portion of the passage 36 and the speed of the folding passage 36 or the side belts 32 is set to one-N'th of the traveling speed of the first tobacco band 16. Accordingly, the tobacco layer $T_{LH}$ delivered from between the band 16 and the belt 20 dives into the folding passage 36 at the initial velocity $V_1$ and vertically vibrates like waves in the folding passage 36, as shown in FIG. 13. However, the amplitude of the vibration of the tobacco layer $T_{LH}$ is regulated by the lower and upper plates 38 and 39 which constitute the lower and upper walls, respectively, of the passage 36.

In the folding passage 36, therefore, the cut tobacco layer $T_{LH}$ advances with alternate turns $L_P$ of a predetermined length. As shown in FIG. 15, therefore, these layer turns $L_P$ securely pile in intimate contact with one another in their advancing direction at the terminal end portion of the folding passage 36, whereupon the cut tobacco train $L_R$ is formed including the layer turns $L_P$ continuous with one another. In FIG. 15, for convenience of illustration, the cut tobacco train $L_R$ is shown by marking a large number of the short horizontals. However, these horizontals do not indicate the direction of the leaf surfaces of the tobacco shreds $K_T$. The leaf surfaces of the tobacco shreds $K_T$ rather extend in the direction crossing at right angles to these horizontals in the cut tobacco train $L_R$. The same is true for the short horizontals in the layer turns $L_P$ shown in FIG. 13.

Figure 16:
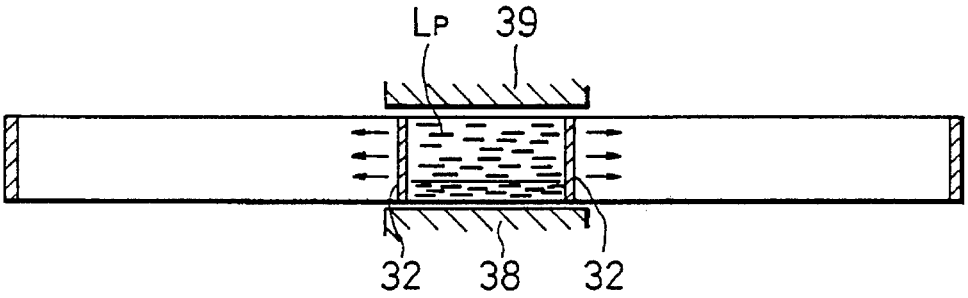
FIG. 16 is a sectional view taken along the line XVI—XVI of FIG. 13.

Meanwhile, the respective belt surfaces of the paired side belts 32, which form the opposite side walls of the folding passage 36, attract the layer turns $L_P$ from both sides, as shown in FIG. 16, and travel in the same direction as the first tobacco band 16 at the speed $V_2$ lower than the traveling speed $V_1$ of the band 16. Thus, the side belts 32 prevent the advancing speed of the layer turns $L_P$ in the folding passage 36 from suddenly dropping, and forms the cut tobacco train $L_R$ with stability. Further, the belts 32 transports the formed tobacco train $L_R$ from the folding passage 36 toward the second tobacco band 26.

The higher the traveling speed $V_1$ of the first tobacco band 16, the thinner the cut tobacco layer $T_{LH}$ formed on the band 16 and the individual layer turns $L_P$ forming the cut tobacco train $L_R$ will be. As a result, the number of layer turns $L_P$ per unit length of the tobacco train $L_R$ can be increased. If the tobacco layer $T_{LH}$ is too thin, however, the tobacco train $L_R$ cannot be formed. Thus, the traveling speed $V_1$ of the first tobacco band 16 should be set properly.

Although the traveling speed $V_1$ of the first tobacco band 16 and the press belt 20 is N times as high as the traveling speed $V_2$ of the paired side belts 32, as mentioned before, the width of each side belt 32, that is, the height of each side wall of the folding passage 36, is about N times the thickness of the cut tobacco layer $T_{LH}$. Therefore, the delivery of the tobacco layer $T_{LH}$ from the first tobacco band 16 is equal to the delivery of the cut tobacco train $L_R$ from the folding passage 36. Thus, the tobacco train $L_R$ can be steadily supplied to the second tobacco band 26 in a manner such that it is guided by the lower plate 38 of the folding stack 24.

Since the second tobacco band 26 is run at the traveling speed V2 which is equal to the traveling speed of the side belts 32, the cut tobacco train $L_R$, delivered from the folding passage 36 and supported on the lower plate 38, are securely attracted to the second tobacco band 26. As the band 26 travels, therefore, the tobacco train $L_R$ is transported toward the aforesaid wrapping section 12. In doing this, the tobacco train $L_R$ passes through the trimming disk 30, and is trimmed as the disk 30 rotates.

Figure 17:
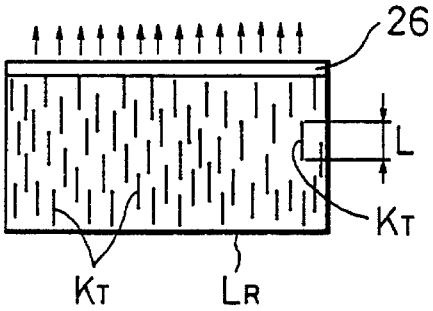
FIG. 17 is an enlarged view of a region XVII— XVII shown in FIG. 15.

As is evident from the foregoing description, the cut tobacco train $L_R$ is formed by piling the layer turns $L_P$ on one another in the advancing direction thereof, so that the long sides $K_{le}$ of most of the tobacco shreds $K_T$ are not parallel to the suction surface of the second tobacco band 26, but extend vertically, as shown in FIG. 17. Thus, the tobacco train $L_R$ constitutes a stack in which the respective surfaces of most of the tobacco shreds $K_T$ pile on one another in the traveling direction of the suction of the second tobacco band 26.

Thereafter, the cut tobacco train $L_R$ is transferred from the second tobacco band 26 to the paper web 2 in the wrapping section 12. In this section 12, a cigarette rod is continuously formed from the paper web 2 and the tobacco train $L_R$ in the conventional manner.

More specifically, the wrapping section 12 is provided with an endless garniture tape 40 which is used for the transportation of the paper web 2 and the formation of the cigarette rod, as shown in FIG. 11. When the garniture tape 40 is run in the direction of the arrow of FIG. 11, the paper web 2 paid out from a web roll (not shown) passes the wrapping section 12 in a manner such that it is put on the tape 40.

When the cut tobacco train $L_R$ on the paper web 2 passes a rod mold 42 of the wrapping section 12, the paper web 2 is bent in the shape of a U, and a paste is applied to one side edge of the U-shaped paper web 2 by means of a paste applicator 44. Thereafter, both sides of the U-shaped web 2 are successively bent in a circular arc, and are lapped to be bonded to each other, whereby a continuous cigarette rod is formed.

As the formed cigarette rod passes a dryer 46 located between the wrapping section 12 and a cutting device 48 in the cutting section 13, its paste-covered portion is dried. The cutting device 48 cuts the cigarette rod into individual cigarettes with a predetermined length.

Figure 18:
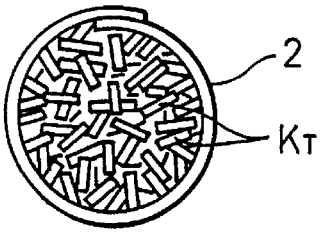
FIG. 18 is an end view of a cigarette manufactured by means of the cigarette manufacturing machine shown in FIG. 11.

Since most of the tobacco shreds $K_T$ of the cut tobacco train $L_R$ on the paper web 2 extend at right angles to the web 2, most of the tobacco shreds $K_T$ in the cigarette rod formed in the aforesaid manner are arranged radially on a transverse cross section of the rod, as shown in FIG. 18.

Figure 19:
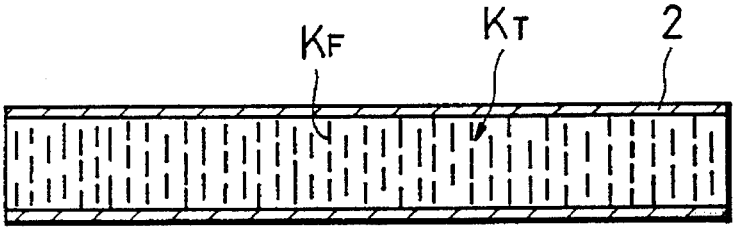
FIG. 19 is a longitudinal section view of the cigarette shown in FIG. 18.

FIG. 19 shows a longitudinal cross section of the cigarette. As is apparent from the figure, most of the tobacco shreds $K_T$ are arranged so that their leaf surfaces $K_F$ cross at right angles to the axis of the cigarette. As for the reasons why the tobacco shreds $K_T$ are radially arranged in the transverse cross section of rod or cigarette, first, it can be considered that the tobacco shreds $K_T$ take different orientations during transportation by air and at the time when they are attracted onto the tobacco band 16. Second, it can be considered that the angular moment is applied to the tobacco shreds $K_T$ arranged in the vicinity of the paper web 2 by the paper web 2 when the paper web 2 is bent in the shape of a U, as described above, during formation of the cigarette rod in the wrapping section, so that the tobacco shreds $K_T$ are radially arranged.

As described above, most of the tobacco shreds $K_T$ are arranged so that their leaf surfaces $K_F$ cross at right angles to the axis of the cigarette. Preferably, the tobacco shreds $K_T$ are radially arranged in the transverse cross section of the cigarette. Accordingly, the formed cigarette rod or each cigarette has a uniform hardness with respect to its circumferential direction, and is harder than a conventional cigarette.

Thus, the cigarettes of the present invention manufactured by means of the aforesaid cigarette manufacturing machine have an increased strength against external force, and cannot be easily deformed. Also, the external appearance of the cigarettes can be maintained despite the execution of a process for manufacturing filter cigarettes by attaching a filter to each cigarette and a process for encasing the filter cigarettes.

If a hardness substantially equal to that of the conventional cigarettes is permitted, the fill of the cut tobacco in each cigarette obtained according to the present invention can be made smaller than that for each conventional cigarette, so that the manufacturing cost can be reduced.

In order to obtain data indicative of the hardness of cigarettes according to the present invention, the present inventor and others manufactured cigarettes having different filling density of cut tobacco by means of the aforesaid machine and method. Then, the hardness of individual cigarettes was measured according to the following procedures.

Figure 20:
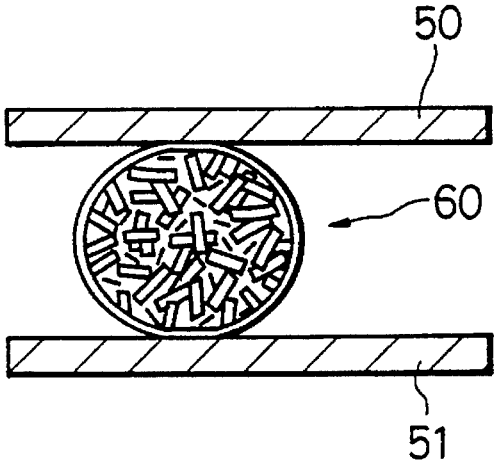
FIG. 20 is a schematic view showing a measurement principle of hardness data of the cigarette.

First, as shown in FIG. 20, a cigarette 60 was interposed between a movable plate 50 and a stationary plate 51. Next, a predetermined compression force was applied to the cigarette 60 by means of a pressure source (not shown) through the plate 50 to deform the cigarette, and a distance between the plates 50 and 51 at that time, that is, a diameter of the cigarette after deformation was measured. Further, an amount of deformation of the cigarette diameter was calculated on the basis of the thus measured diameter of the deformed cigarette and a previously measured diameter of the cigarette before deformation. Furthermore, the amount of deformation thus calculated was divided by the cigarette diameter before deformation to calculate distortion caused in the cigarette 60 by application of the compression force. The harder the cigarette is, the smaller the distortion becomes; therefore, the distortion thus calculated is indicative of a hardness of the cigarette 60.

Figure 21:
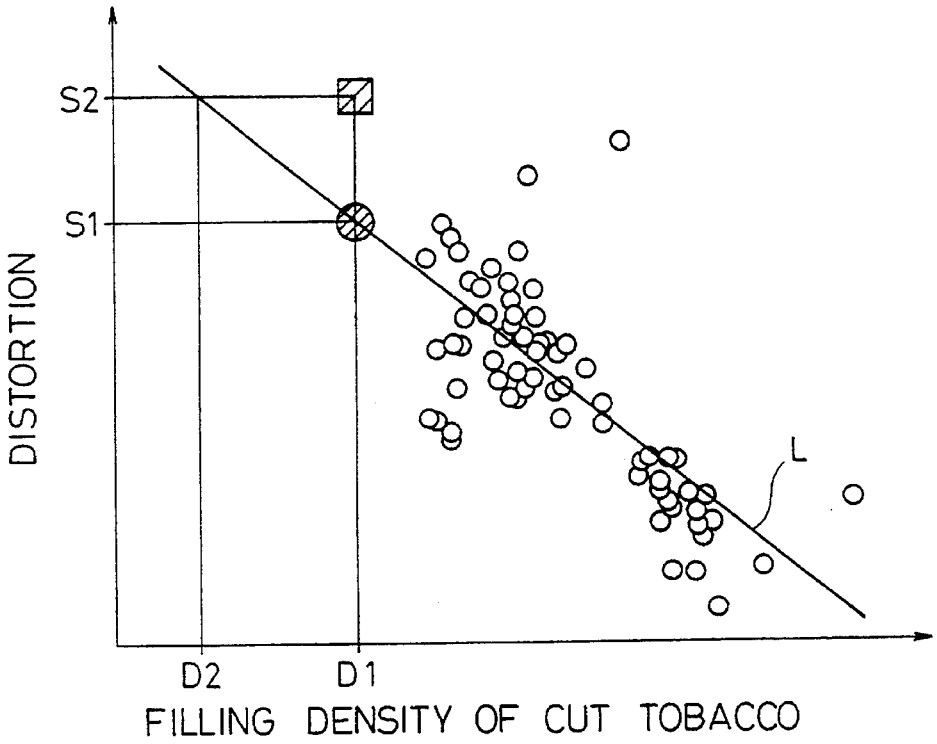
FIG. 21 is a graph in which filling density of cut tobacco and distortion are plotted in abscissa and ordinate, respectively, and which shows measurement results of the hardness of the cigarette.

FIG. 21 shows results of the hardness measurement according to the above procedures; taking distortion in ordinate, and filling density of cut tobacco in abscissa. In the figure, circular marks denote measurement data about individual cigarettes. The straight line L, showing the relation between filling density of cut tobacco and distortion in the cigarettes of the present invention, was obtained according to a regression analysis based on these measurement data.

Further, in FIG. 21, a hatched square mark denotes measurement data about a typical cigarette, and a filling density of cut tobacco (standard filling density of cut tobacco) in the cigarette is shown by the mark D1. Furthermore, a hatched circular mark is positioned on the intersection point of a straight line, passing through the point of the standard filling density D1 of tobacco shreds and extending parallel to the ordinate, and the aforesaid straight line L. Thus, the hatched circular mark indicates that the distortion S1 occurs in the cigarette of the present invention having the standard filling density D1 of cut tobacco when the aforesaid predetermined compression force is applied to the cigarette. The hatched square mark indicates that the distortion S2 occurs in the conventional cigarette having the standard filling density D1 of cut tobacco when the predetermined compression force is applied to the cigarette. In this manner, the distortion S1 caused in the cigarette of the present invention is smaller than the distortion S2 caused in the conventional cigarette under the condition that the filling density of cut tobacco shreds is the same. In other words, the cigarette of the present invention is harder than the conventional one. A hardness increase rate is about (S2 – S1)/S2%, e.g., about 10%.

As is obvious from FIG. 21, moreover, even if the filling density of cut tobacco is considerably reduced, the present invention can provide a hardness equivalent to that of the conventional cigarette. More specifically, in the case where an occurrence of distortion equivalent to the distortion S2 of the conventional cigarette having the standard filling density D1 of cut tobacco is permitted. The cigarette of the present invention has the filling density of D2. Therefore, in the case of obtaining the same distortion or hardness, a reduction rate of about (D1 – D2)/D1%, e.g., about 7% in filling density of cut tobacco can be attained by the present invention. That is, it is possible to reduce cut tobacco by about 7% by weight when manufacturing the cigarette equivalent to conventional one.

In order to evaluate impact resistance of a cigarette of the present invention, the present inventor and others manufactured a cigarette of the present invention with use of the same weight of cut tobacco per cigarette as that of a conventional one, and measured impact resistance of the cigarette of the present invention and the conventional cigarette.

Figure 22:
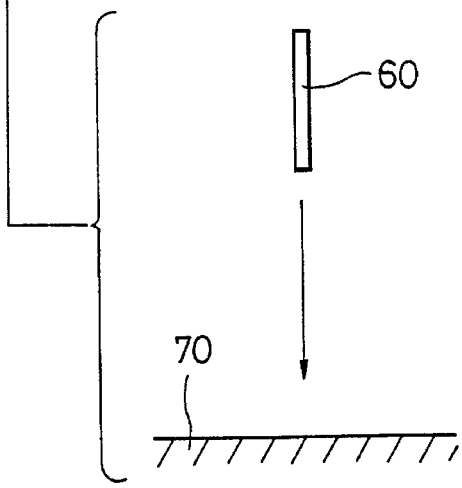
FIG. 22 is a schematic view showing a measurement principle of impact resistance of the cigarette.

In the impact resistance measurement, the cigarette 60 was held perpendicularly to a horizontal surface 70 at such a height that a distance from the lower end of the cigarette to the horizontal surface 70 is 20 cm, as shown in FIG. 22, and then free fell therefrom. Further, the free fall was repeated four times, likewise. After the free fall was made five times in totality, an amount of concavity or depression caused in cut tobacco of the upper end portion of the cigarette 60 was measured. Pursuant to the measurement result, a concavity of about 2 mm occurred in the conventional cigarette. On the contrary, no substantive concavity occurred in the cigarette of the present invention. As is clear from the measurement result, it was, therefore, found that the cigarette of the present invention was excellent in impact resistance.

It is to be understood that the present invention is not limited to the one embodiment described above, and that various changes and modifications may be effected therein by one skilled in the art without departing from the scope or spirit of the invention. In the above-described embodiment, for example, the folding passage 36 of the folding stack 24 is defined by the pair of side belts 32 and the pair of plates 38 and 39. However, these members may be replaced with a fixed member having the folding passage 36 defined therein. Preferably, in this case, the inner surface of the passage 36 should be smooth enough to guide the cut tobacco train satisfactorily in sliding motion as the tobacco train is formed.

From the above-described embodiments of the present invention, it is apparent that the present invention may be modified as would occur to one of ordinary skill in the art without departing from the spirit and scope of the present invention which should be defined solely by the appended claims. All such modifications as would be obvious to one of ordinary skill in the art should not be regarded as a departure from the spirit and scope of the invention, and should be include within the scope of the invention as defined solely by the appended claims.

What is claimed is:

1. A cigarette in which a filler including tobacco shreds obtained by cutting tobacco leaves is wrapped in a packing member made of paper, the tobacco shreds having a width and length, wherein said tobacco shreds are arranged so that most of said tobacco shreds have the length of their leaf surfaces extending substantially perpendicularly to a longitudinal axis of said cigarette and wherein most of said tobacco shreds are radially arranged around the axis of said cigarette in a cross section intersecting perpendicularly to the axis of said cigarette.

2. The cigarette according to claim 1, wherein said cigarette includes a cut tobacco train as said filler, said cut tobacco train being composed of cut tobacco layer portions, which individually extend substantially perpendicularly to the axis of said cigarette and which overlap with one another.

3. The cigarette according to claim 2, wherein said cut tobacco train is formed by executing a folding process for delivering a cut tobacco layer, obtained by arranging the tobacco shreds, in one direction, and for folding said cut tobacco layer into said cut tobacco layer portions.

4. The cigarette according to claim 3, wherein said cut tobacco train is formed by executing said folding process within a limited space, while delivering said cut tobacco train in the same direction as a direction of delivery of said tobacco layer at a speed later smaller than a delivering speed of said cut tobacco layer.

5. The cigarette according to claim 2, wherein said cigarette is manufactured by a cigarette manufacturing process including a cut tobacco supply step, said supply step including:

a first supply process for forming said cut tobacco layer by suction and continuously delivering the formed cut tobacco layer;

a folding and forming process for folding the delivered cut tobacco layer into said cut tobacco layer portions and piling the layer portions on one another in a direction of delivery of the cut tobacco layer to form said cut tobacco train; and a second supply process for receiving the formed cut tobacco train by suction and continuously delivering the received cut tobacco train.

6. The cigarette according to claim 5, wherein said cigarette is manufactured by executing a wrapping step of wrapping said cut tobacco train in the packing member to form a continuous cigarette rod and a cutting step of cutting said cigarette rod into a predetermined length, after said cut tobacco supply step is performed.

7. The cigarette according to claim 1, wherein most of the tobacco shreds which have their leaf surfaces extending substantially perpendicularly to the axis of the cigarette have all of their leaf surfaces substantially perpendicular to the axis such that the tobacco shreds are unbent.

* * * * *

UNITED STATES PATENT AND TRADEMARK OFFICE

CERTIFICATE OF CORRECTION

PATENT NO. : 5,497,794
DATED : Mar. 12, 1996
INVENTOR(S) : Yutaka Okumoto

It is certified that error appears in the above-indentified patent and that said Letters Patent is hereby corrected as shown below:

On the cover page under

"[*] Notice:", change the date from "Aug. 16, 2011" to --Dec. 30, 2013--.

Signed and Sealed this

Seventeenth Day of September, 1996

*Attest:*

Bruce Lehman

BRUCE LEHMAN

*Attesting Officer*

*Commissioner of Patents and Trademarks*